United States Patent [19]

Frahm et al.

[11] 4,015,741

[45] Apr. 5, 1977

[54] COLLAPSIBLE CARRYING CASE

[76] Inventors: Carl E. Frahm; Shirley E. Frahm, both of 1428 Oak Meadow Rd., Arcadia, Calif. 91106

[22] Filed: Aug. 15, 1975

[21] Appl. No.: 605,161

[52] U.S. Cl. ..... 220/6; 217/14

[51] Int. Cl.[2] ..... B65D 7/24; B65D 9/14

[58] Field of Search ..... 220/6, 7; 217/12, 13, 217/14, 15, 16

[56] References Cited

UNITED STATES PATENTS

| | | | |
|---|---|---|---|
| 586,725 | 7/1897 | Ellenbecker | 217/16 |
| 1,110,726 | 9/1914 | Szuth | 217/14 |
| 1,301,650 | 4/1919 | Chapman | 220/7 |

*Primary Examiner*—William Price
*Assistant Examiner*—Steven M. Pollard
*Attorney, Agent, or Firm*—Frank E. Mauritz

[57] ABSTRACT

A collapsible carton is provided with two bottom closure flaps. A center divider is also provided which has its bottom edge extended along the junction between the two bottom flaps. This center divider and the two bottom flaps have intermeshing apertured projections. Each projection has a cylindrical hole extending therethrough and all said projections are alignable to receive a single securing pin.

1 Claim, 3 Drawing Figures

COLLAPSIBLE CARRYING CASE

The present invention relates to an improved storage case.

An object of the present invention is to provide an improved storage case which has a center divider with the capability that the case will be collapsed and the center divider sandwiched for convenient space saving storage.

Another object of the present invention is to provide improved case featured by improved means for securing elements thereof, including divider such that the case may be conveniently opened or collapsed as desired for convenient use or storage.

The features of the present invention which are believed to be novel are set forth with particularity in the appended claims.

This invention itself, both as to its organization and manner of operation, together with further objects and advantages thereof, may be best understood by reference to the following description taken in connection with the accompanying drawings in which.

Figure 1:
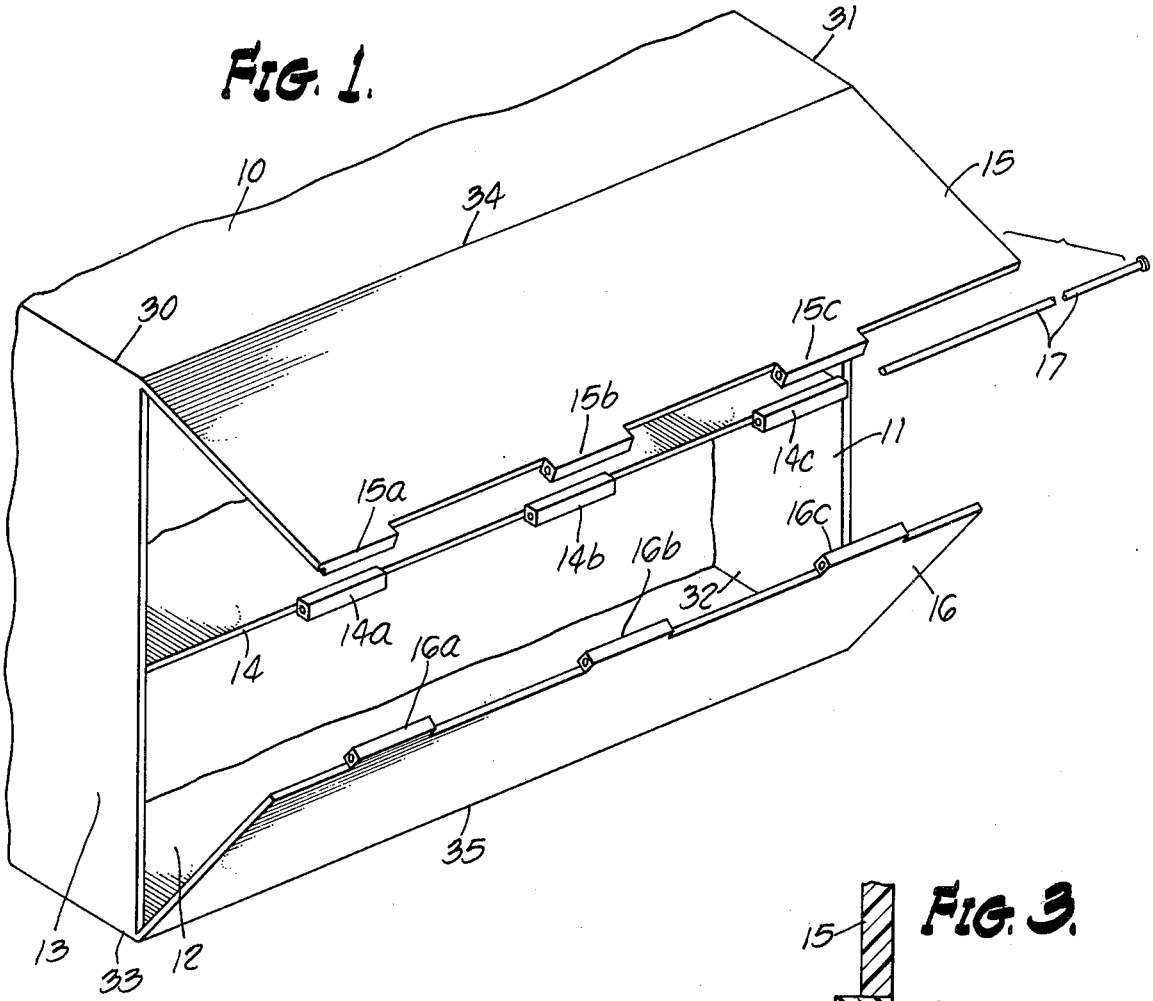
FIG. 1 is a perspective view of the bottom of the case with elements detached.
Figure 3:
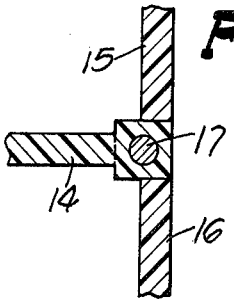
FIG. 3 is a sectional view taken substantially as indicated by the line 3—3 in FIG. 2.

The case may be of cardboard or plastic material. The case includes four side walls 10, 11, 12, 13, a removable center divider 14, two bottom closure flaps 15 and 16 and an elongated pin 17, of metal or plastic which is threadable through alignable apertured portions of the bottom flaps 15 and 16 and center flaps 14.

The case may be open at its top end or closable by flaps (not shown) in conventional manner.

That part of the case comprising the elements 10, 11, 12, 13, 15, and 16 as indicated previously may be made of plastic or cardboard construction, is inherent flexibility at the corners 30, 31, 32, 33 and also at the junctions 34 and 35 of the corresponding bottom flaps 15 and 16 so that the case may be folded flat with the center divider 14 sandwiched between the end walls 10 and 12 for convenient storage. During such storage, the pin 17 may also be stored by threading the same through with the aligned apertured portions **15*a*, 15*b*, 15*c*, of flap 15 or through the aligned apertured portions 14*a*, 14*b*, 14*c* of center divider 14 or through the aligned apertured portions 16*a*, 16*b*, 16*c* of the other bottom flap 16.**

Figure 2:
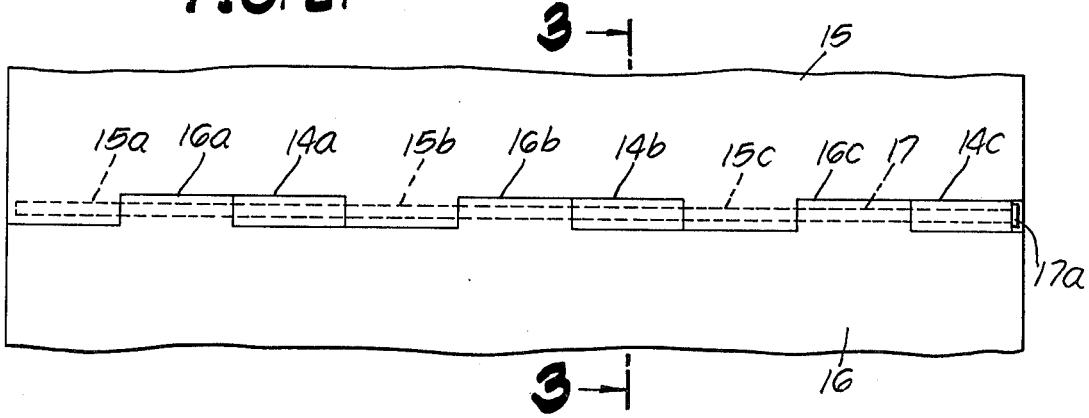
FIG. 2 is a view on elevation of a portion of the bottom of the case with elements in assembled condition.

The case is assembled in the manner indicated in FIG. 1 by opening up the case such that the walls 11 and 13 extend parallel to each other and then the end flaps 15 and 16 are folded together with the apertured portions **14*a*, 14*b*, and 14*c* of the center divider 14 being aligned with the apertured portions 15*a*, 15*b*, 15*c* and apertured portions 16*a*, 16*b*, 16*c*, in which case the pin 17 is then threaded through all of the aligned apertured portions in the manner illustrated in FIG. 2. Preferably, the head 17*a* of pin 17** is then recessed within the general confines of the case.

Subsequently, if and when desired, the case may be disassembled for storage or other purposes by removing the pin 17, opening of the flaps 15 and 16 and then folding the case to sandwich the center divider 14 between the side walls 10 and 12; and as indicated previously the pin 17 may be stored by threading the same through the aligned apertured portions of either the flap 15 or 16 or the center divider 14.

While the particular embodiments of the present invention have been shown and described, it will be obvious to those skilled in the art that changes and modifications may be made without departing from the invention in its broader aspects and, therefore, the aim in the appended claims is to cover all changes and modifications as fall within the true spirit and scope of this invention.

We claim:

1. A collapsible case having a pair of end walls and a pair of side walls and two flaps serving as the bottom for the case, a divider in said case, said divider and said flaps each having alignable openings, and a pin extending through said alignable openings, said end walls are hinged on corresponding ones of said side walls and said flaps are hinged on a corresponding one of said side walls, and said pin being removable from said alignable openings in said divider and in said flaps to allow said divider to be detached from said flaps and to allow said flaps to hinge on said side walls and said end walls to hinge on said side walls such that said end walls, side walls, and flaps may be folded to assume a general planer flat structure with said divider sandwiched therein between said end walls and said side walls.

* * * * *